US010095187B2

(12) United States Patent
Di Domenico et al.

(10) Patent No.: US 10,095,187 B2
(45) Date of Patent: Oct. 9, 2018

(54) MAGNETIC ESCAPE WHEEL SET FOR TIMEPIECES

(71) Applicant: The Swatch Group Research and Development Ltd, Marin (CH)

(72) Inventors: Gianni Di Domenico, Neuchatel (CH); Dominique Lechot, Les Reussilles (CH); Jerome Favre, Neuchatel (CH); Benoit Legeret, Ecublens (CH); Davide Sarchi, Zurich (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/410,244

(22) Filed: Jan. 19, 2017

(65) Prior Publication Data

US 2017/0242403 A1 Aug. 24, 2017

(30) Foreign Application Priority Data

Feb. 18, 2016 (EP) ..... 16156326

(51) Int. Cl.
*G04B 15/08* (2006.01)
*G04B 15/14* (2006.01)
(Continued)

(52) U.S. Cl.
CPC ..... *G04C 5/005* (2013.01); *G04B 15/08* (2013.01); *G04B 15/14* (2013.01); *G04C 3/047* (2013.01)

(58) Field of Classification Search
CPC ..... G04C 3/105; G04C 5/005; G04C 3/047; G04B 15/14; G04B 17/06; G04B 17/32; G04B 15/08
See application file for complete search history.

(56) References Cited

U.S. PATENT DOCUMENTS 2,690,646 A * 10/1954 Clifford ..... G04C 5/005 310/103
3,183,426 A * 5/1965 Haydon ..... G04C 5/005 368/132

(Continued)

FOREIGN PATENT DOCUMENTS

EP 2 887 157 A1 6/2015
EP 2 889 701 A2 7/2015
EP 2 891 930 A2 7/2015

OTHER PUBLICATIONS

European Search Report dated Jul. 20, 2016 in European Application 16156326.7, filed on Feb. 18, 2016 (with English Translation of Categories of cited documents).

*Primary Examiner* — Vit W Miska
(74) *Attorney, Agent, or Firm* — Oblon, McClelland, Maier & Neustadt, L.L.P.

(57) ABSTRACT

Watch with a timepiece movement, a resonator mechanism, including a magnetic escapement mechanism including an escape wheel set including a magnetized track, with a succession of areas according to a scrolling period in which its magnetic features are repeated, each area including an increasing magnetic field ramp followed by a magnetic field barrier with an increasing field and of higher field gradient that that of the ramp, the track includes a continuous, closed magnetic layer over the entire periphery of the escape wheel set, of constant thickness and variable width, whose geometry defines these magnetic field ramps and barriers, this escape wheel set cooperating with a sprung balance via a pivoting magnetic stop member comprising a pole piece arranged to cooperate alternately with an internal track and an external track of the magnetic layer.

26 Claims, 6 Drawing Sheets

(51) Int. Cl.
*G04C 5/00* (2006.01)
*G04C 3/04* (2006.01)

(56) References Cited

U.S. PATENT DOCUMENTS

| | | | | |
|---|---|---|---|---|
| 3,410,083 | A * | 11/1968 | Korr | G04C 5/005 368/126 |
| 9,389,591 | B2 * | 7/2016 | Born | G04C 5/005 |
| 9,715,217 | B2 * | 7/2017 | Di Domenico | G04C 5/005 |
| 9,746,829 | B2 * | 8/2017 | Stranczl | G04C 5/005 |
| 9,785,116 | B2 * | 10/2017 | Winkler | G04B 17/20 |
| 9,804,570 | B2 * | 10/2017 | Winkler | G04B 37/088 |
| 2015/0177690 | A1 | 6/2015 | Di Domenico et al. | |
| 2015/0177697 | A1 | 6/2015 | Di Domenico et al. | |
| 2015/0177698 | A1 | 6/2015 | Di Domenico et al. | |

* cited by examiner

MAGNETIC ESCAPE WHEEL SET FOR TIMEPIECES

This application claims priority from European Patent Application No. 16156326.7 filed on Feb. 18, 2016, the entire disclosure of which is hereby incorporated herein by reference.

FIELD OF THE INVENTION

The invention concerns an escape wheel set for a magnetic timepiece escapement mechanism, comprising at least one magnetized track, with a succession of areas according to a scrolling period in which its magnetic features are repeated, each said area comprising an increasing magnetic field ramp followed by a magnetic field barrier with an increasing field and whose field gradient is greater than that of said ramp.

The invention also concerns a magnetic timepiece escapement mechanism, comprising, subjected to a drive torque, such an escape wheel set, cooperating indirectly with a sprung balance resonator via a stop member.

The invention also concerns a resonator mechanism, comprising an energy source arranged to drive said escape wheel of a said magnetic escapement mechanism, via a gear train.

The invention also concerns a movement including at least one such resonator mechanism.

The invention also concerns a watch including at least one movement of this type.

The invention concerns the field of timepiece regulating mechanisms, and more particularly field-effect, contactless or reduced contact escapement mechanisms of the magnetic or electrostatic type.

BACKGROUND OF THE INVENTION

In a Swiss lever escapement, the escape wheel interacts with the pallet-lever with the aid of a mechanical contact force, which generates significant friction and reduces the efficiency of the escapement.

EP Patent Application 13199427 in the name of THE SWATCH GROUP RESEARCH & DEVELOPMENT Ltd discloses the replacement of this mechanical interaction with contactless forces of magnetic or electrostatic origin, which, amongst other things, minimises losses through friction.

The practical embodiment of a magnetic lever escapement requires the interaction energy to be varied using ramps and barriers, as described in the above document.

As regards the magnetic interaction between wheel sets, the prior art mentions the use of discrete magnets interacting with other discrete magnets, such as, for example, in U.S. Pat. No. 3,183,426, or discrete magnets interacting with an iron structure as in FR Patent 2075383 and GB Patent 671360. The use of iron is justified by its ease of machining, which makes it possible to produce small structures that are regularly repeated over the circumference of a wheel. However, magnet-magnet interaction is preferred when the escape wheel moves in jerks, since the energy required to stop the wheel is greater than for continuous systems. Moreover, the use of discrete magnets does not easily allow energy to be continuously varied, in a gentle and linear manner, to produce ramps in an optimum manner as described in the aforecited EP Patent Application 13199427.

SUMMARY OF THE INVENTION

The invention proposes to devise a geometry for an escape wheel set, notably for an escape wheel, which can create magnetic interaction potential consisting of ramps and barriers. This wheel geometry must be able to be achieved with current technologies for fabricating micro magnets.

To this end, the invention concerns an escape wheel set for a magnetic timepiece escapement mechanism according to claim 1.

The invention also concerns a magnetic timepiece escapement mechanism, comprising, subjected to a drive torque, such an escape wheel set, cooperating indirectly with a sprung balance resonator via a stop member.

The invention also concerns a resonator mechanism, comprising an energy source arranged to drive said escape wheel of a said magnetic escapement mechanism, via a gear train.

The invention also concerns a movement including at least one such resonator mechanism.

The invention also concerns a watch including at least one movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
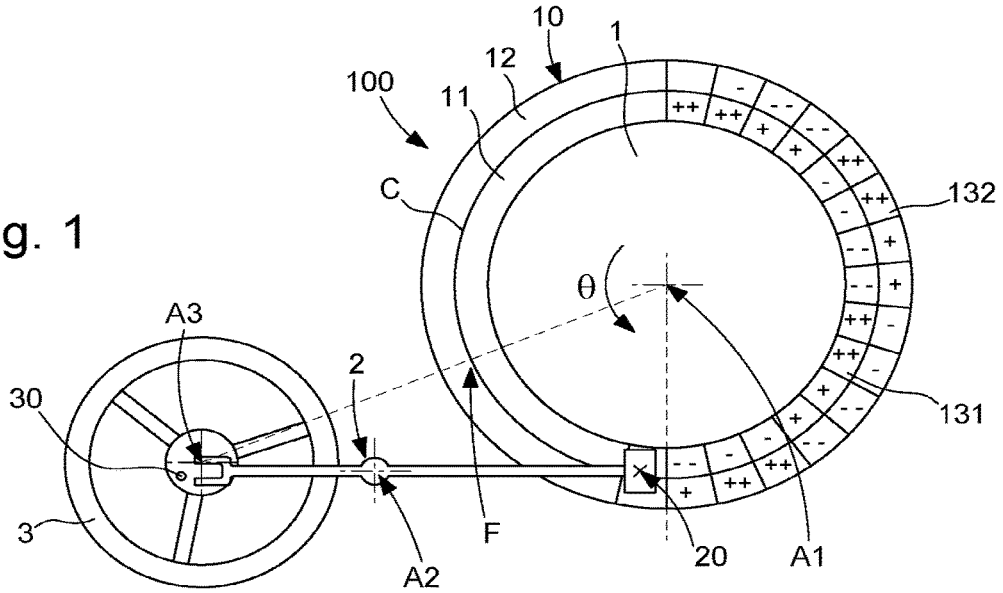
FIG. 1 represents a schematic plan view of a magnetic escapement mechanism described in EP Patent Application 13199427, comprising an escape wheel with internal and external magnetized tracks, cooperating with a pole piece of a magnetic pallet-lever.

The invention concerns an escape wheel set 1 for a magnetic timepiece escapement mechanism 100.

This wheel set 1 includes a surface S which is the largest surface of wheel set 1, or one of the largest surfaces of wheel set 1; for example when wheel set 1 is a disc, surface S may be its upper side or underside.

The escape wheel set 1 includes at least one magnetized track 10, with a succession of areas according to a scrolling rotation period PD in which its magnetic features are repeated, each area comprising an increasing magnetic field ramp followed by a magnetic field barrier with an increasing field and whose field gradient is greater than that of the preceding ramp.

According to the invention, magnetized track 10 includes a continuous, closed magnetic layer 4. More particularly, this magnetic track is a continuous, closed magnetic layer 4 over the entire periphery of escape wheel set 1.

More particularly, this magnetic track is of constant thickness and variable width.

In another particular embodiment, the variations in magnetic potential are caused by a variation in the thickness of the layer.

More particularly, this magnetic track extends over a larger surface S of escape wheel set 1, and whose geometry in projection onto surface S defines the magnetic field ramps and barriers.

In a particular case, magnetized track 10 comprises a physical layer composed of discrete elements, not necessarily formed of magnets of simple geometry, but, for example, with curvilinear portions, which can also form a functional mechanism according to the invention.

It is also possible to obtain a magnetic track of similar effect with a layer having a remanent field that is not constant. In practice, this can be achieved either by heating the magnetic layer locally to a controlled temperature, or by superimposing two different magnetic materials, for example SmCo and NdFeB, and heating to a temperature that neutralises the NdFeB remanent field without affecting the SmCo remanent field.

It is understood that the magnetic field variations may be angular variations of the field, and that the variation in field gradient between the ramp part and the barriers may also be variation in the angular component of the field.

In a particular embodiment, and as illustrated by the Figures, escape wheel set 1 is an escape wheel, and comprises at least one ring or one disc or one hollowed disc one side of which carries magnetized track 10, and, in a particular and non-limiting manner, constitutes the largest surface S of wheel set 1. The width of magnetic layer 4 extends in the radial direction with respect to the axis A1 of the disc.

More particularly, magnetized track 10 comprises, adjacent on either side of a boundary F, an internal track 11 and an external track 12 including magnetic field barriers staggered with respect to boundary F, in alternate half-periods. In the case of an escape wheel, this boundary F, is a circle C, concentric to the two tracks 11 and 12.

More particularly, magnetic escapement mechanism 100 comprises, subjected to a drive torque, one such escape wheel set 1 cooperating indirectly with a sprung balance resonator via a stop member 2, which is a pivoting magnetic stop member comprising at least one pole piece 20 arranged to cooperate alternately with internal track 11 and external track 12 of a magnetic layer 4.

FIG. 1 illustrates the principle of a magnetic escapement mechanism 100, comprising an escape wheel 1 with magnetized tracks 10, internal track 11 and external track 12, separated by a circle C, cooperating with a pole piece 20 of a stop member, notably a magnetic pallet-lever 2, as described in the aforecited EP Patent Application 13199427.

Figure 2:
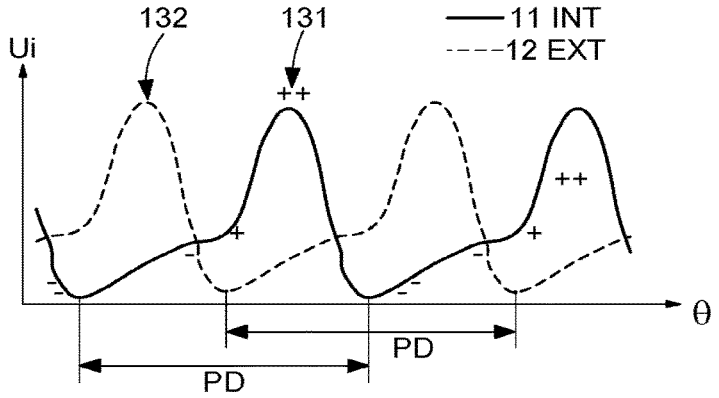
FIG. 2 is a graph relating to the mechanism of FIG. 1, which shows the variation in magnetic interaction energy between the escape wheel and the pole piece of the magnetic pallet-lever comprised in the mechanism.

The magnetic interaction energy between wheel 1 and pole piece 20 of pallet-lever 2, notably comprising at least one magnet, varies as indicated on the graph of FIG. 2 showing the period PD on each of the two tracks. The potential barriers 131, 132, marked + + in FIGS. 1 and 2, have the effect of halting the motion of wheel 1. The energy ramps that extend over both internal track 11 and external track 12, from a "−−" area − − to a "+" area, and which are encountered by pole piece 20 of pallet-lever 2 during the rotation of escape wheel 1, have the effect of accumulating energy, which is transmitted to an impulse pin 30 of balance 3, when pallet-lever 2 tilts.

The invention is described here in a particular, non-limiting embodiment, which is that of a magnetic escapement. It can be implemented in an electrostatic embodiment, with reference to the aforecited EP Patent 13199427.

To form the potential barriers and ramps, a first known solution consists in varying the thickness, or the intensity of magnetization, of magnets disposed on each of tracks 11 and 12, to vary the interaction energy with pole piece 20 of pallet-lever 2.

The variation in thickness of added magnets causes a variation in the air gap between pallet-lever 2 and tracks 10, unless these magnets are embedded in escape wheel 1 and present a surface of the same level to pole piece 20 of pallet-lever 2. Further development thus requires combining control of the field gradient generated by the magnets of tracks 11 and 12, with control of the interaction between pole piece 20 and the magnets inside the air gap, which is difficult due to the discontinuities.

Another alternative consists in varying the intensity of magnetization of the magnets, or of the actual tracks, which is difficult to control properly.

In short, these methods are suitable for laboratory tests, but are difficult to adapt for series production.

Therefore the invention proposes a solution for industrial implementation that is easier than varying the thickness of the magnets or their intensity of magnetization, which consists in using a magnetized layer 4 of constant thickness and magnetization, disposed in the plane of wheel 1 with a specific surface distribution, and whose geometry is devised to produce the desired energy variations formed of ramps and barriers.

Figure 3:
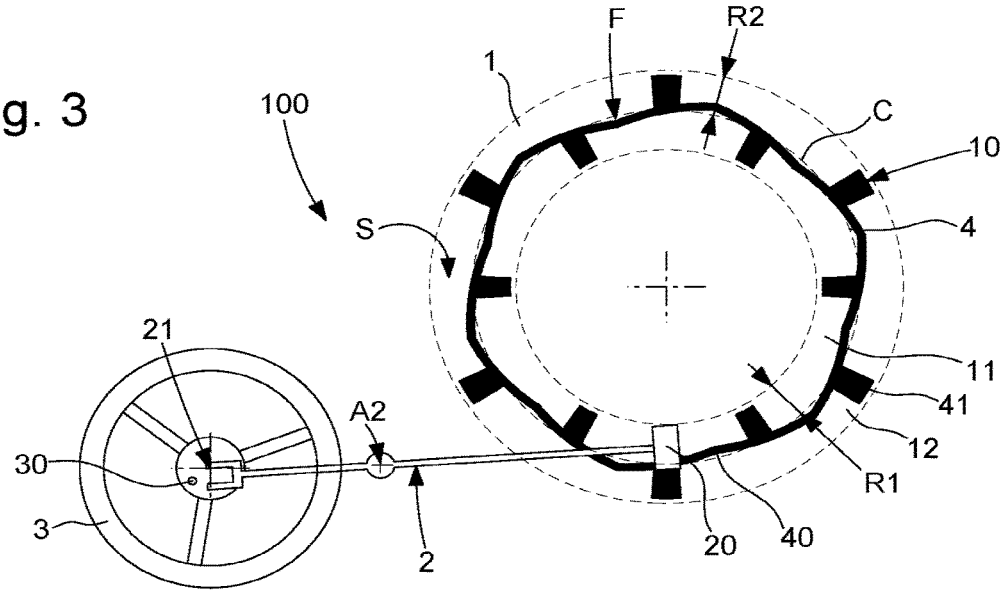
FIG. 3 represents a schematic plan view of a magnetic escape wheel according to the invention, in cooperation with a magnetic pallet-lever cooperating with a balance.

FIG. 3 represents an example of such a geometry: a magnetized layer 4 is disposed on escape wheel 1 and forms a magnetized track 10, which interacts through magnetic repulsion with the pole piece 20 of pallet-lever 2 which is disposed above wheel 1. The geometry of layer 4 is selected such that the interaction with pole piece 20 or the magnets of pallet-lever 2 produces the ramps and the barriers required for proper operation of the magnetic lever escapement.

Figure 4:
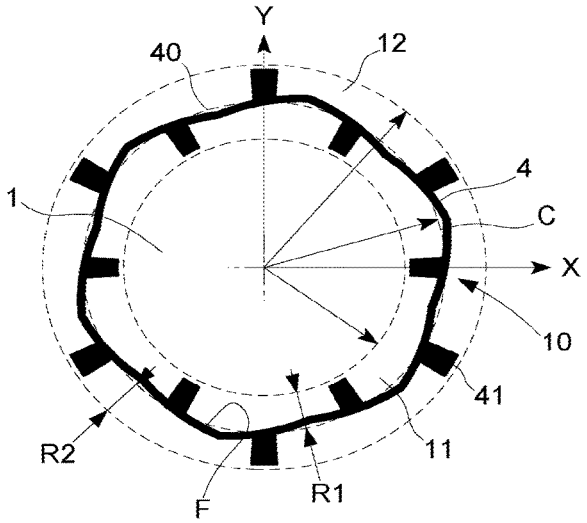
FIG. 4 shows a schematic, plan view of the arrangement of this escape wheel with a magnetic layer according to the invention.

As seen in FIGS. 3 and 4, this magnetized track 10 formed by magnetized layer 4 extends, partly over internal track 11, and partly over external track 12, which correspond to the two extreme positions of pole piece 20 of pallet-lever 2 (abutment against solid banking). Internal track 11 has a radial width R1, external track 12 has a radial width R2. R0 is the radius of circle C which separates internal track 11 and external track 12.

Figure 5:
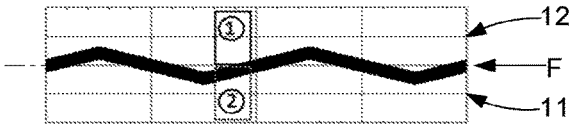
FIGS. 5, 7, 9, illustrate the representation in polar coordinates of the magnetic layer with respect to the escape wheel axis, as regards respectively the potential ramp, the potential barrier, and the two combined.
Figure 6:
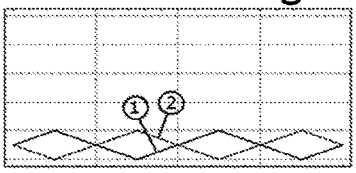
FIGS. 6, 8, 10 respectively illustrate the corresponding shapes of the associated ramps and barriers.
Figure 7:
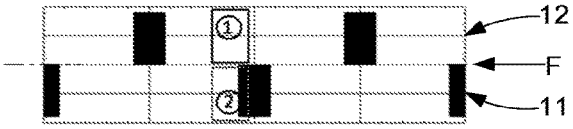
Figure 8:
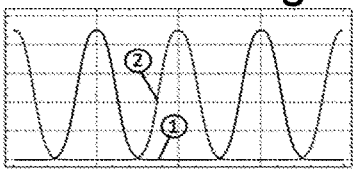
Figure 9:
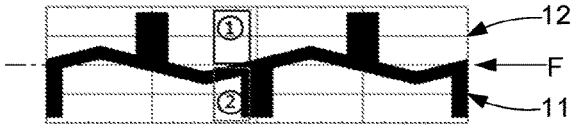
Figure 10:
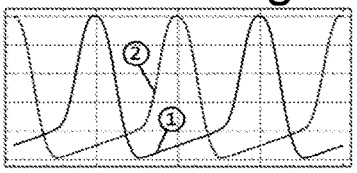

To properly understand the method for devising the geometry of magnetic layer 4, FIGS. 5 to 10 illustrate the representation in polar coordinates of said layer with respect to the axis of escape wheel 1 in FIGS. 5, 7 and 9, with the relative eccentric arrangement of surfaces as a function of the central angle added to period PD, and respectively FIGS. 6, 8 and 10 illustrate the corresponding shapes of the associated ramps and barriers.

FIG. 5 represents two angular periods of internal track 11 and external track 12 with a magnetic layer 4 that follows a continuous periodic path alternating in a substantially symmetrical manner, particularly but not limited to triangular, to produce the potential ramps. The variation in interaction energy of pallet-lever 2 with pole piece 20 is represented in FIG. 6 in solid lines when pole piece 20 is on external track 12 (position 1) and in dashed lines when pole piece 20 is on internal track 11 (position 2). The interaction energy increases when the superposition of magnetic track 4 of wheel 1 and of pole piece 20 of pallet-lever 2 increases. The periodic path profile may also be substantially sinusoidal or other, depending on the desired ramp profiles. The linear profile of this example is advantageous for lowering the minimum maintenance torque CE allowing operation of the escapement.

Likewise, FIG. 7 represents two angular periods of internal track 11 and external track 12 with a magnetic layer 4 that is formed of discrete barrier studs 41, formed here of rectangular areas, to produce the potential barriers. The corresponding variation in interaction energy is represented in FIG. 8 in solid lines when pole piece 20 is on external track 12 (position 1) and in dashed lines when pole piece 20 is on internal track 11 (position 2).

Finally, FIG. 9 represents two angular periods of internal track 11 and external track 12 with a magnetic layer 4 which is the sum of the ramps of FIG. 5 and the barriers of FIG. 7. The corresponding variation in interaction energy is represented in FIG. 10 in solid lines when pole piece 20 is on external track 12 (position 1) and in dashed lines when pole piece 20 is on internal track 11 (position 2). It is observed that the desired result is obtained, i.e. potential ramps followed by barriers, which alternate in succession on the two paths 11 and 12.

Naturally, the discrete barrier studs 41 are of rectangular shape here for ease of modelling. They can also adopt other similar shapes, provided such shapes remain compatible with the desired distribution of magnetic potential.

When the geometry of FIG. 10 is converted into Cartesian coordinates, the magnetic layer geometry represented in FIGS. 3 and 4 is obtained, provided, naturally, that the pattern is repeated as many times as necessary to cover the entire wheel 1. For the non-limiting example of wheel 1 of FIGS. 3 and 4, N=6 steps per revolution has been chosen, so that the value of angular period PD is PD=2 Pi/6. Of course, another value can be chosen for the number N of steps per revolution. In practice, it is advantageous for N to be as high as possible, the upper limit being set by the technology used and by the air gap between pole piece 20 of pallet-lever 2 and wheel 1.

It is understood that the geometry of magnetic layer 4 depends on that of wheel 1. In particular, if the latter is of small diameter and if N is low, it may be advantageous for R1 to be greater than R2, to offset the curvature, and to obtain identical ramp and barrier profile features on the two tracks 11 and 12. The example of the Figures corresponds to the particular case where R1 and R2 are equal.

Different variants, which can generally be combined, can further improve proper operation of the system. Some may, in particular, use a plurality of very thin magnetic layers 4, which may then be achieved by methods other than mechanical methods, particularly electrochemical methods, plasma deposition or other means.

According to a feature of the invention, magnetic layer 4 extends alternately over internal track 11 and external track 12.

More particularly, magnetic layer 4 comprises, at each half-period, a barrier stud 41 forming a magnetic field barrier, extending on only one side of boundary F, and alternately on internal track 11 and external track 12.

More particularly still, these barrier studs 41 are connected, one after the other, by a band 40 of smaller width than the smallest width of barrier studs 41.

More particularly still, band 40 changes concavity on either side of each barrier stud 41, and remains on the same side of boundary F between two successive barrier studs 41.

In particular, band 40 includes a narrow portion 42 next to each barrier stud 41.

In particular, band 40 includes a cusp 46 between two successive barrier studs 41.

Figure 11:
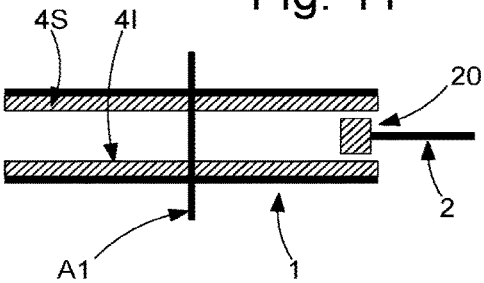
FIG. 11 represents a schematic cross-sectional view of a wheel formed of two magnetized layers for offsetting axial forces by compensation, both layers repelling the pallet-lever magnet.

To offset axial stresses on escape wheel 1, it is advantageous to use a variant of wheel 1 comprising two magnetic layers 4, upper layer 4S and lower layer 4I, between which pole piece 20 of pallet-lever 2 is sandwiched, as represented in FIG. 11. Let us recall that pole piece 20 of pallet-lever 2 acts via magnetic repulsion with magnetized layers 4S and 4I of wheel 1. It is naturally possible to devise an escape wheel 1 with an even higher number of levels, and a pallet-lever 2 comprising as many pole pieces as there are spaces delimited in pairs by the different magnetic layers 4 of the different layers to cumulate the effects, within the vertical space allowed by the movement in which escapement mechanism 100 is incorporated.

Thus, more particularly, escape wheel set 1 comprises a plurality of parallel discs whose opposite faces each carry a magnetized track 10 in symmetry relative to each other with respect to a median plane perpendicular to the common axis of the discs, and the width of each magnetic layer 4 extends in the radial direction with respect to the disc axis. More particularly, the two end discs of this plurality of discs each include, on the side opposite to the plurality of discs, a ferromagnetic layer forming a magnetic shield protecting the wheel set from external magnetic fields.

More particularly still, magnetic escapement mechanism 100 includes such an escape wheel set 1, and stop member 2 comprises at least one pole piece 20 in each air gap wherein the parallel discs with opposite faces each carry a magnetized track 10.

It is thus possible to have a configuration with several stages of pallet-lever magnets, each pallet-lever magnet working between two specific stages of the escape wheel.

Figure 12:
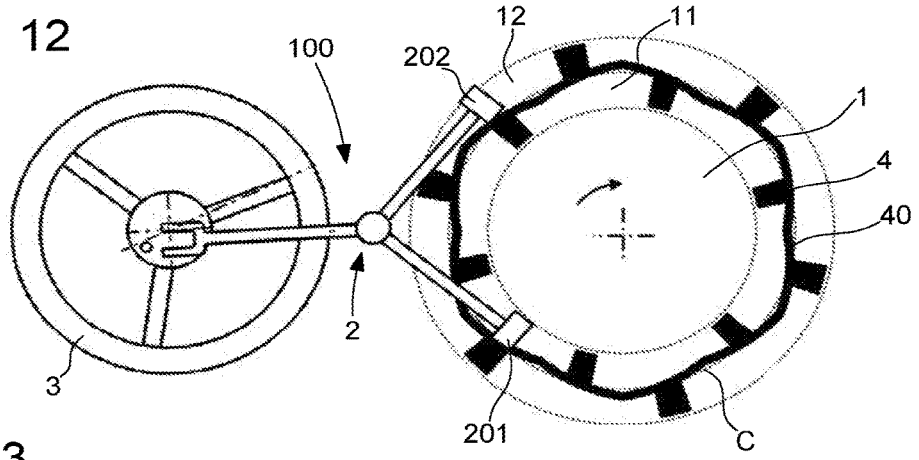
FIG. 12 represents a schematic plan view of an advantageous variant wherein the pallet-lever comprises two pole pieces angularly arranged to work alternately, in the extreme angular positions of the pallet-lever, one with the internal track, the other with the external track.

FIG. 12 illustrates an advantageous variant wherein pallet-lever 2 comprises two pole pieces 201 and 202, angularly arranged to work alternately, in the extreme angular positions of pallet-lever 2, one with internal track 11, the other with external track 12, and the stresses are thus added to each other. This configuration has numerous advantages. First, the difference in torque due to the difference in radius between internal track 11 and external track 12 is offset since there is always one of the pole pieces of pallet-lever 2 which is on internal track 11 while the other is on external track 12. Next, irregularities in the manufacture of wheel 1, from one angular period to another, are averaged out since the pallet-lever pole pieces do not encounter the same defects. Finally, the torques transmitted up on each vibration are doubled.

Figure 13:
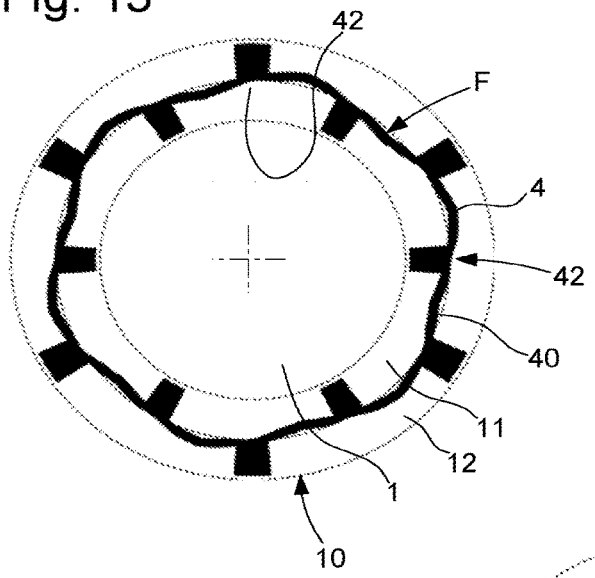
FIG. 13 represents a schematic plan view of narrow portions of the magnetized track for optimising the linearity of the magnetic interaction potential ramps.

To lower the minimum operating torque CE of the escapement, it is important for the magnetic potential ramp to be as linear as possible. To this end, small adjustments can be made to the geometry of magnetic layer 4. For example, it is advantageous to make a small narrow portion 42 in magnetic layer 4, when the pallet-lever pole piece passes in proximity to a barrier that is on the adjacent track, as represented in FIG. 13. These narrow portions 42 of the magnetized track can optimise the linearity of the magnetic interaction potential ramps.

This manufacture is also important in series production.

An advantageous method for making magnetic layer(s) 4 of escape wheel 1 consists in using a substrate that ensures mechanical strength, and on which magnetized layer 4 is deposited, which is typically NdFeB or SmCo or alloys of Pt and Co. Indeed, since thin layers of rare earth magnets are fragile, it is advantageous to reinforce them with a substrate. The layer can be deposited by CVD or PVD type methods or by galvanic growth. The desired geometry can be obtained by placing a removable mask on the substrate before carrying out the deposition; the mask can then be removed. It is also possible to deposit the layer in a uniform manner on the (CVD, PVD, or bonded) substrate and then perform an etch of the undesired areas. In all these situations, the geometries presented thus far can be used since mechanical strength is ensured by the substrate. The advantage of multi-level escape wheels is clear in the case of this method of elaboration.

Figure 14:
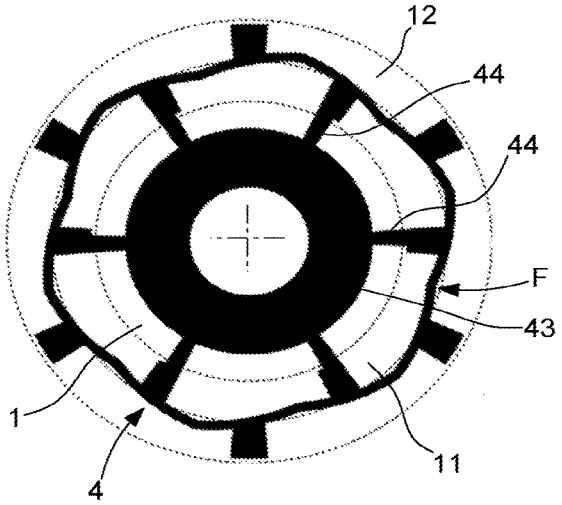
FIG. 14 represents a schematic plan view of an area of mechanical reinforcement of the wheel, which comprises a central ring connected by stiffening spokes to some of the barrier studs of the magnetic layer.

Another variant embodiment concerns the fabrication of magnetic layer 4 by machining the desired geometry in a thin magnet plate, whether by conventional methods, laser cutting, electrical discharge machining or chemical etching. It is then advantageous to complete magnetic layer 4 with stiffeners 44 extending into the central area of the escape wheel 1, outside the areas swept by pallet-lever 2, to ensure the mechanical stability of the fabricated component. An example is seen in FIG. 14, where the area of mechanical reinforcement extends towards axis A1 of wheel 1, and essentially outside internal track 11, comprises a central ring 43 connected by stiffening spokes 44 to some of barrier studs 41 of magnetic layer 4. More specifically, the stiffening spokes 44 are connected to barrier studs 41 of internal track 11 as they are the parts least sensitive to an interfering field. The area of mechanical reinforcement thus formed ensures mechanical stability, without thereby significantly changing the magnetic interaction potential between pallet-lever 2 and wheel 1.

Figure 15:
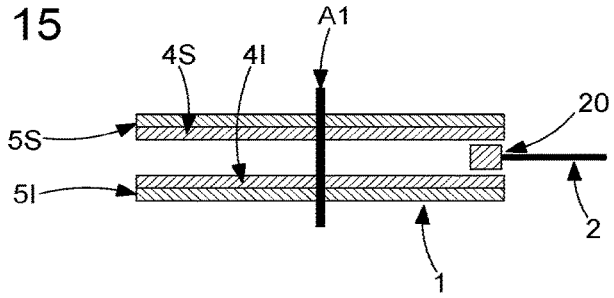
FIG. 15 represents, in a similar manner to FIG. 11, the use of a ferromagnetic layer, in particular made of iron, as the magnetic shield or circuit of the wheel.

Another variant concerns the use of a ferromagnetic layer 5, in particular made of iron, as a magnetic shield or circuit of wheel 1. This layer can also be used as a substrate for magnetized layer 4 and thus ensure mechanical strength. FIG. 15 shows a similar arrangement to that of FIG. 11, wherein wheel 1 includes an external upper ferromagnetic layer 5S, and an external lower ferromagnetic layer 5I, each respectively carrying upper magnetized layer 4S and lower magnetized layer 4I. This arrangement allows for the best separation of magnetic fields external to wheel 1 whose effects on the escapement it is desired to halt, from fields internal to magnetic escapement mechanism 100, which are necessary for operation of the escapement.

Figure 16:
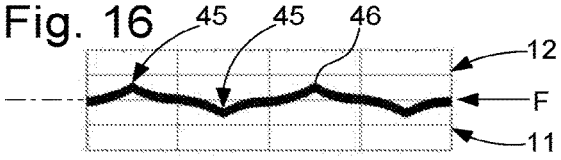
FIGS. 16, 17, 18, represent, in a similar manner to FIGS. 5, 7 and 9, modification of the profile by the incorporation of non-linearities, in the form of cusps, to offset the non-linearities in magnetic interaction.
Figure 17:
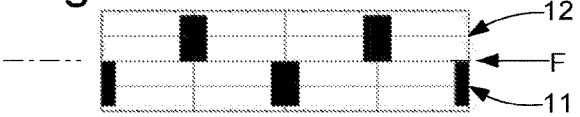

It may be necessary to adapt the shape of the ramps of magnetic layer 4 according to the constitution of wheel 1, with or without ferromagnetic material, particularly iron. Indeed, the presence of such a shield of ferromagnetic material introduces non-linearities into the magnetic interaction of the pallet-lever and wheel. These non-linearities must be offset to obtain potential ramps that are as linear as possible. As above, it is possible to introduce variations in the width of magnetic layer 4 via narrows portions 42. Another method consists in slightly modifying the shape of the triangular profile, seen in FIG. 5, which is used to produce the ramps. For example, in FIG. 16, this profile is modified by the incorporation of non-linearities 45, particularly in the form of cusps 46, to offset the non-linearities in the magnetic interaction. This profile is then combined with barrier studs 41 of FIG. 17 to obtain the geometry of FIG. 18 in polar coordinates. Finally, the geometry is converted into Cartesian coordinates and FIG. 19 is obtained, which is an alternative to the geometry of FIG. 13.

Figure 20:
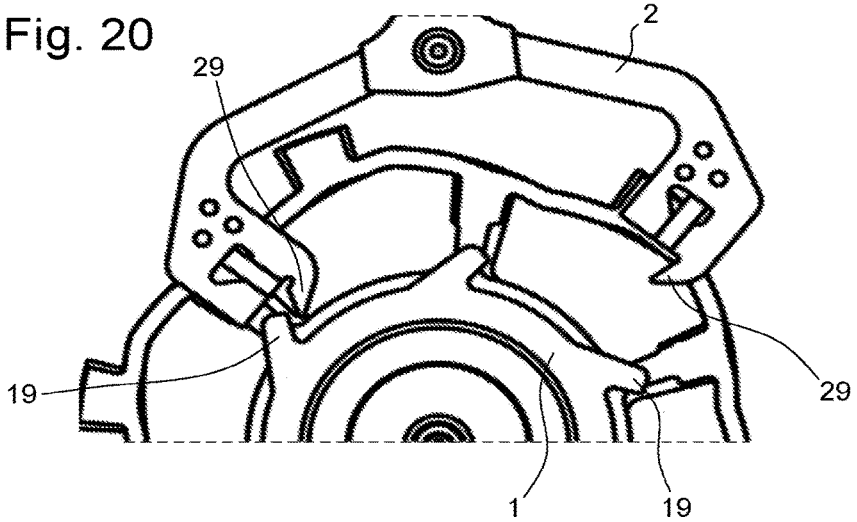
FIG. 20 represents a schematic plan view of a detail of an anti-shock device formed by mechanical stops on the wheel and on the pallet-lever.

FIG. 20 shows a variant with mechanical stops 19 on wheel 1 and complementary mechanical stops 29 on pallet-lever 2, to ensure that the system does not stall in the event of a shock. These stops must be arranged to block the motion of wheel 1 when the pole piece of the pallet-lever passes a magnetic barrier following a shock.

In a variant, the anti-stalling stops are of the magnetic type. An advantageous variant thus includes a small magnet on each point of the anti-stalling star, and a ferromagnetic piece on the pallet-lever stop: in such case, at the first rebound, magnetic attraction allows almost all the energy from the impact to be dissipated by immediately stopping the rebound. The correct draw position is then recovered owing to the main magnetic potential (wheel—pallet magnet). In a second variant, the magnets situated on each point of the star work via magnetic repulsion with magnets situated on the anti-stalling stops of the pallet-lever: in such case, any risk of collision (destroying the stops) is eliminated, while allowing more freedom in the design of the magnetic wheel and in the indexing of the star.

Figure 21:
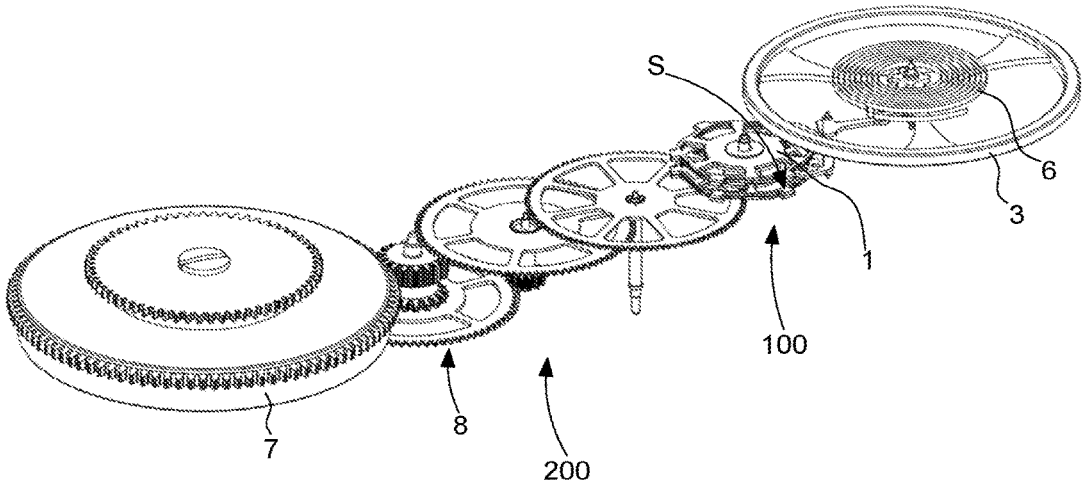
FIG. 21 represents a schematic perspective view of the entire resonator mechanism comprising, from a barrel, to the sprung balance resonator, a gear train, and a magnetic escapement mechanism with a magnetic pallet-lever.
Figure 22:
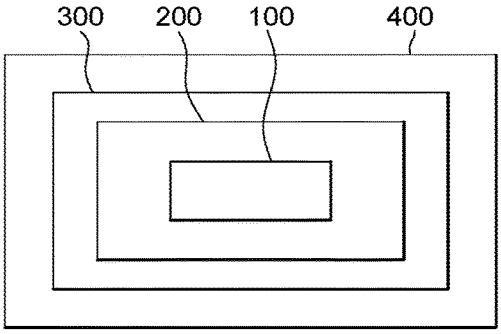
FIG. 22 is a block diagram representing a watch including a movement equipped with such an optimised magnetic lever escapement mechanism.
Figure 23:
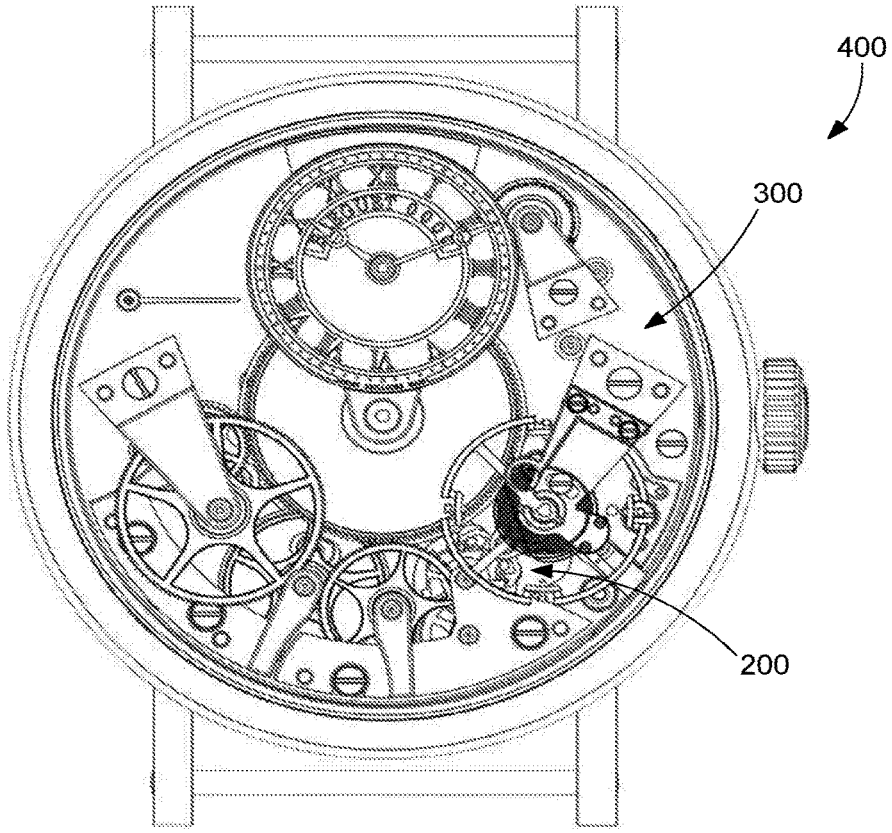
FIGS. 23 and 24 represent plan and perspective views of a watch comprising such a magnetic escapement mechanism.
Figure 24:
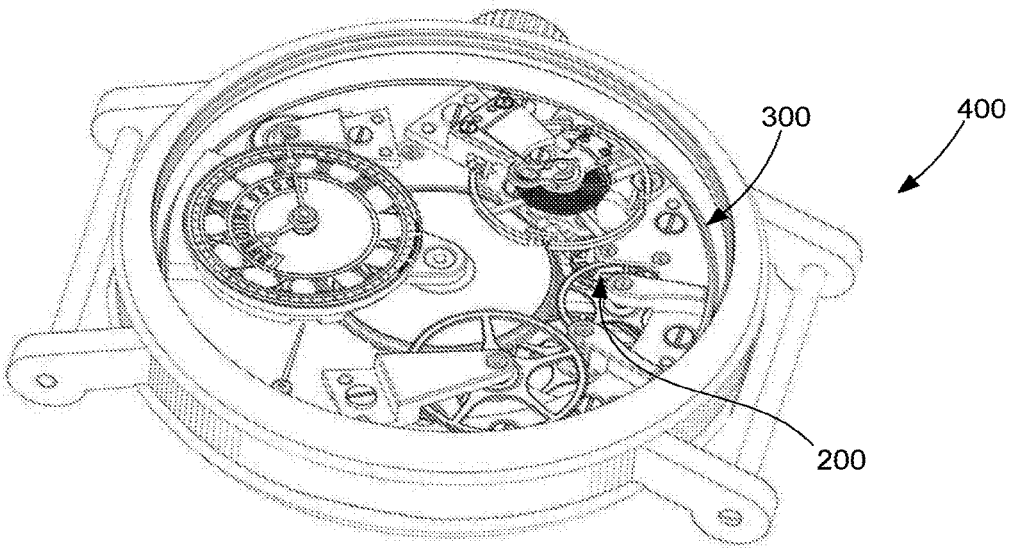

FIG. 21 shows an entire resonator mechanism 200, comprising, from an energy source consisting here of a barrel 7, to the sprung balance resonator, with balance 3 and balance spring 6, a gear train 8 and a magnetic escapement mechanism 100 with a magnetic pallet-lever 2.

Figure 18:
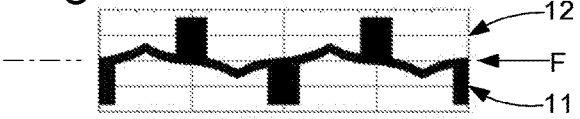
Figure 19:
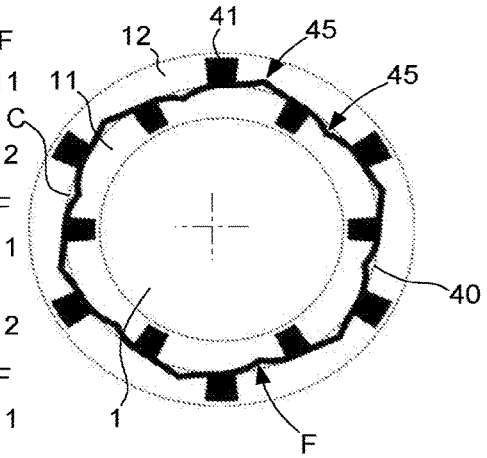
FIG. 19 represents a schematic plan view of the associated wheel.

Naturally, although the examples described concern a escapement wheel set formed by a wheel, the teaching of the invention is applicable to a wheel set of any shape, for example the variants of EP Patent Application 13199427 where the escape wheel set is a cylinder, or a continuous band, in which case the profile of magnetic layer 4 can be directly that of FIG. 9 or 18, or a warped escape wheel set, for example but not limited to wings on the potential ramps and/or barriers.

The invention also concerns a movement 300 including at least one such resonator mechanism 200.

The invention also concerns a watch 400 including at least one movement 300 of this type.

What is claimed is:

1. An escape wheel set of a magnetic timepiece escapement mechanism, comprising a surface which is a largest surface of said wheel set or one of largest surfaces of said wheel set, said wheel set including at least one magnetized track, with a succession of areas according to a scrolling period in which magnetic features thereof are repeated, each of said areas including an increasing magnetic field ramp followed by a magnetic field barrier with an increasing field and whose field gradient is higher than that of said ramp, wherein said magnetized track includes a continuous, closed magnetic layer that extends over said largest surface of said escape wheel set, and whose geometry, in projection onto said largest surface, defines said magnetic ramps and magnetic field barriers.

2. The escape wheel set according to claim 1, wherein said magnetic layer extends over the entire periphery of said escape wheel set.

3. The escape wheel set according to claim 1, wherein said magnetic layer includes constant thickness and a variable width.

4. The escape wheel set according to claim 1, wherein said escape wheel set includes at least one disc of which at least one side forms said largest surface and carries said magnetized track, and a width of said magnetic layer extends in the radial direction with respect to the axis of said disc.

5. The escape wheel set according to claim 1, wherein said magnetized track comprises, adjacent on either side of a boundary, an internal track and an external track including said magnetic field barriers staggered with respect to said boundary, in alternate half-periods.

6. The escape wheel set according to claim 5, wherein said magnetic layer extends alternately over said internal track and said external track.

7. The escape wheel set according to claim 6, wherein said magnetic layer comprises, at each half-period, a barrier stud forming a said magnetic field barrier, extending on only one side of said boundary, and alternately on said internal track and on said external track.

8. The escape wheel set according to claim 7, wherein said barrier studs are connected, one after the other, by a band of smaller width than the smallest width of said barrier studs.

9. The escape wheel set according to claim 8, wherein said band changes concavity on either side of each said barrier stud, and remains on the same side of said boundary between two successive said barrier studs.

10. The escape wheel set according to claim 9, wherein said band comprises a narrow portion next to each said barrier stud.

11. The escape wheel set according to claim 10, wherein said band comprises a cusp between two successive said barrier studs.

12. The escape wheel set according to claim 7, wherein said escape wheel set includes at least one disc of which at least one side forms said largest surface and carries said magnetized track, a width of said magnetic layer extending in the radial direction with respect to the axis of said disc, and wherein said magnetic layer includes a central ring connected by stiffener spokes to some of said barrier studs of said internal track.

13. The escape wheel set according to claim 1, wherein said escape wheel set includes at least one substrate ensuring mechanical strength which is coated with a magnetized layer of NdFeB or of SmCo or of alloys Pt and Co forming a said magnetic layer.

14. The escape wheel set according to claim 1, wherein said escape wheel set comprises a plurality of parallel discs whose opposite faces each carry a said magnetized track in symmetry relative to each other with respect to a median plane perpendicular to the common axis of said discs, and wherein, a width of each said magnetic layer extends in the radial direction with respect to the axis of each respective said disc.

15. The escape wheel set according to claim 14, wherein said two end discs of said plurality of discs each include, on the side opposite to the plurality of discs, a ferromagnetic layer forming a magnetic shield protecting said wheel set from external magnetic fields.

16. A magnetic timepiece escapement mechanism comprising, subjected to a drive torque, an escape wheel set according to claim 1 cooperating indirectly with a sprung balance resonator via a stop member, wherein said stop member is a pivoting magnetic stop member comprising at least one pole piece to cooperate alternately with an internal track and an external track as defined by said magnetic layer.

17. The magnetic timepiece escapement mechanism according to claim 16, wherein said magnetized track comprises, adjacent on either side of a boundary, said internal track and said external track including said magnetic field barriers staggered with respect to said boundary, in alternate half-periods.

18. The magnetic timepiece escapement mechanism according to claim 16, wherein said escape wheel set includes at least one substrate ensuring mechanical strength which is coated with a magnetized layer of NdFeB or of SmCo or of alloys Pt and Co forming a said magnetic layer.

19. The magnetic timepiece escapement mechanism according to claim 16, wherein said escape wheel set comprises a plurality of parallel discs whose opposite faces each carry a said magnetized track in symmetry relative to each other with respect to a median plane perpendicular to the common axis of said discs, and wherein a width of each said magnetic layer extends in the radial direction with respect to the axis of each respective said disc.

20. The magnetic timepiece escapement mechanism according to claim 19, wherein said stop member comprises at least one pole piece in each air gap wherein the parallel discs with opposite faces each carry a said magnetized track.

21. The magnetic timepiece escapement mechanism according to claim 16, wherein said stop member comprises two pole pieces angularly disposed to work alternately, in the extreme angular positions of said stop member, one with said internal track, and the other with said external track.

22. The magnetic timepiece escapement mechanism according to claim 16, wherein said escape wheel includes mechanical stops and said stop member includes complementary mechanical stops for preventing any stalling in the event of a shock.

23. A resonator mechanism comprising an energy source to drive, via a gear train, said escape wheel of a said magnetic escapement mechanism according to claim 16.

24. A timepiece movement comprising at least one resonator mechanism according to claim 23.

25. A watch comprising at least one timepiece movement according to claim 24.

26. A magnetic timepiece escapement mechanism according to claim 1, wherein said magnetized track also includes an internal track and an external track adjacent to a shared boundary, said magnetic layer substantially defined by said shared boundary.

* * * * *